United States Patent [19]

Kortenbrede

[11] Patent Number: 4,831,849

[45] Date of Patent: May 23, 1989

[54] CABLE LOCK

[75] Inventor: Ludger Kortenbrede, Telgte, Fed. Rep. of Germany

[73] Assignee: Aug. Winkhaus GmbH & Co. KG

[21] Appl. No.: 114,306

[22] Filed: Oct. 27, 1987

[30] Foreign Application Priority Data

Nov. 4, 1986 [DE] Fed. Rep. of Germany ... 8629478[U]

[51] Int. Cl.[4] ..... E05B 67/06; E05B 67/38

[52] U.S. Cl. ..... 70/49; 70/54; 70/417

[58] Field of Search ..... 70/18, 30, 49, 50, 52, 70/54–56, 57, 58, 416, 417

[56] References Cited

U.S. PATENT DOCUMENTS

| | | | |
|---|---|---|---|
| 212,892 | 3/1879 | Budd | 70/52 |
| 613,065 | 10/1898 | House | 70/52 X |
| 1,662,612 | 3/1928 | Junkunc | 70/55 X |
| 3,435,642 | 4/1969 | Del Pesco | 70/49 |
| 3,808,847 | 5/1974 | Vesely | 70/56 X |
| 3,983,725 | 10/1976 | Manuel | 70/55 |
| 4,075,878 | 2/1978 | Best | 70/49 |
| 4,134,280 | 1/1979 | Pelavin | 70/55 |
| 4,297,861 | 11/1981 | Dykes | 70/55 |
| 4,354,365 | 10/1982 | Mayer et al. | 70/30 |
| 4,419,873 | 12/1983 | Sopko | 70/52 X |

FOREIGN PATENT DOCUMENTS

| | | | |
|---|---|---|---|
| 962322 | 4/1957 | Fed. Rep. of Germany | 70/49 |
| 979740 | 5/1951 | France | 70/49 |
| 1596781 | 8/1981 | United Kingdom | 70/49 |

*Primary Examiner*—Robert L. Wolfe
*Assistant Examiner*—Suzanne L. Dino
*Attorney, Agent, or Firm*—Toren, McGeady & Associates

[57] ABSTRACT

The cable lock comprises a flexible cable portion and an elongate lock body to which the cable portion is secured, oriented in the longitudinal direction of the lock body, by a first end and can be attached, oriented transversely to the longitudinal direction of the lock body, by a second end. A plastics housing, furnished with through openings for the ends of the cable portion, encases the lock body. The housing consists of two housing parts, pushed into each other in the longitudinal direction of the lock body and engaged with each other when pushed in, which housing parts are fixed by abutment surfaces against opposed abutment surfaces of the lock body. The one housing part forms a pocket, disposed laterally of the lock body, into which pocket a projection of the other housing part can be pushed. The pocket increases the peripheral wall length of the housing, which facilitates handling of the lock on account of larger gripping surfaces and improves the engagement action of the detent connection between the two housing parts, provided in the region of the pocket.

8 Claims, 3 Drawing Sheets

CABLE LOCK

BACKGROUND OF THE INVENTION

The invention relates to a cable lock and particularly to a cable lock comprising a flexible cable portion, an elongate lock body to which the cable portion is secured with a first end oriented longitudinally of the lock body and can be attached with a second end oriented transversely to the longitudinal direction of the lock body, and comprising a housing of plastics material encasing the lock body and possessing through openings for the ends of the cable portion.

Cable locks of this type are known. They are utilized especially for securing two-wheeled vehicles, such as bicycles and motor cycles. The plastics housing protects the two-wheeled vehicle from damage to the lacquer due to the lock body which is of metal.

It is the objective of the invention to show a way in which the cost of production for the manufacture and fitting of the plastics housing on the lock body of the cable lock can be reduced.

SUMMARY OF THE INVENTION

According to the invention, the lock body possesses abutment surfaces facing away from each other in its longitudinal direction and the housing consists of two housing parts, pushed into one another longitudinally of the lock body and secured to one another when pushed into one another, which have abutment surfaces facing towards each other in the longitudinal direction of the lock body and enclose the abutment surfaces of the lock body between them. Such a housing can be manufactured separately from the cable lock and subsequently fitted together form-fittingly on the lock body. Such a housing has the shape of a housing cast in one piece on the lock body, but does not require such a large cost of manufacture.

One of the two housing parts is preferably in the form of a tubular cap, especially extending substantially over the entire length of the lock body. This cap forms a pocket, into which the other housing part engages with a projection. The other housing part is favorably a ring or the like, which surrounds the lock body. This embodiment is suitable especially for cable locks, in which a socket block for receiving the closable end of the cable portion projects from the lock body perpendicularly to its longitudinal axis. Since the actual lock body in locks of this class is comparatively small, the housing increases the handling and gripping surfaces of the lock body and imparts to it, even though only apparently, a more solid and therefore more appealing exterior. The above-explained construction, however, is suitable also for lock bodies without a socket block, which have only a socket channel oriented transversely to the longitudinal direction of the lock body. In this embodiment, the cap has a tube projection axially aligning with the socket channel and forming the limit of the pocket in the longitudinal direction of the lock body.

The cable lock is preferably a cylinder lock, the cylinder core of which has a key channel oriented longitudinally of the lock body. For protecting the annular gap between lock body and core, one of the two housing parts is advantageously equipped with an annular flange engaging over this annular gap. It has been found favorable for the annular flange to be provided on the annular housing part which can be pushed into the cap, especially if this ring lies flush with the cap in the longitudinal direction of the lock body, in order to prevent unintentional levering out of the ring.

The two parts of the housing may, for example, be connected together as one piece by gluing or sealing (welding). Manufacture is, however, further simplified if the two housing parts are fixed to one another by a detent connection, which automatically snaps into place when the housing parts are pushed together. An especially secure detent connection is obtained if one of the housing parts surrounds the lock body to form a pocket open longitudinally, the pocket possessing two lateral walls oriented substantially tangentially to the lock body, these walls blending one into the other at a distance from the lock body. The other housing part possesses, for this purpose, a projection which can be plugged into the pocket, detent connections being provided on the projection and on the two lateral walls, each detent connection consisting of a detent knob and a complementary detent recess. The increase in the circumferential length of the housing part forming the pocket ensures sufficient elasticity for the knobs to slide in along the otherwise closed walls into the detent recesses. The two housing parts can thereby be adapted to each other with comparatively low tolerances, which makes possible firmly seated connections.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE DRAWINGS

Figure 1:
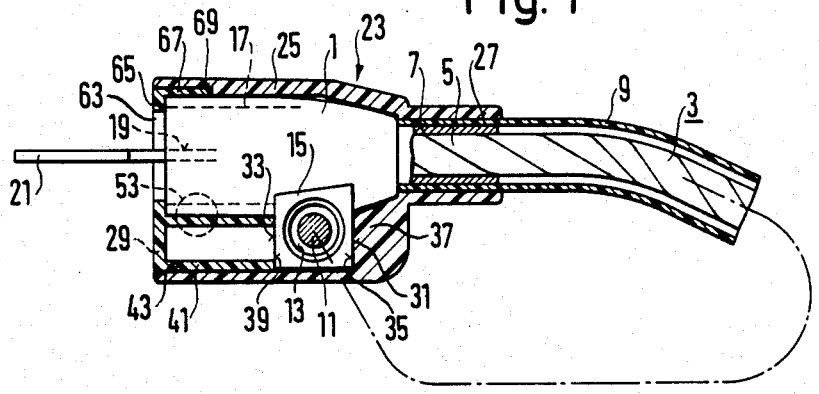
FIG. 1 a partial longitudinal section through a cable lock accord to this invention.
Figure 3:
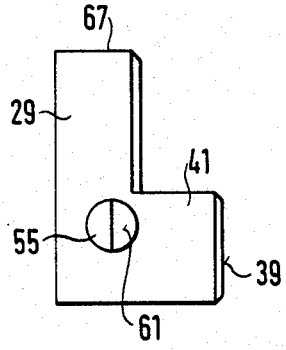
FIG. 3 a clamping piece used for locking the housing cap.
Figure 2:
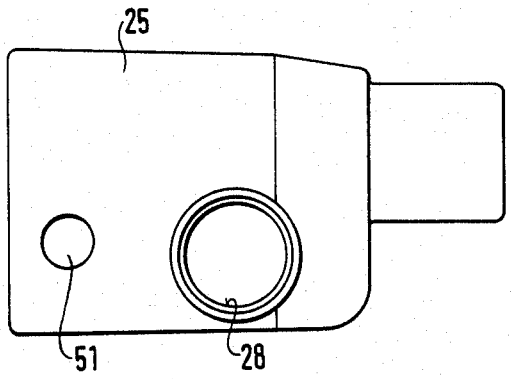
FIG. 2 a lateral view of a housing cap of the cable lock of FIG. 1.
Figure 5:
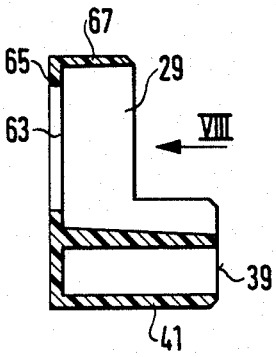
FIG. 5 a longitudinal section through the clamping piece, viewed along a line V—V of FIG. 8.
Figure 4:
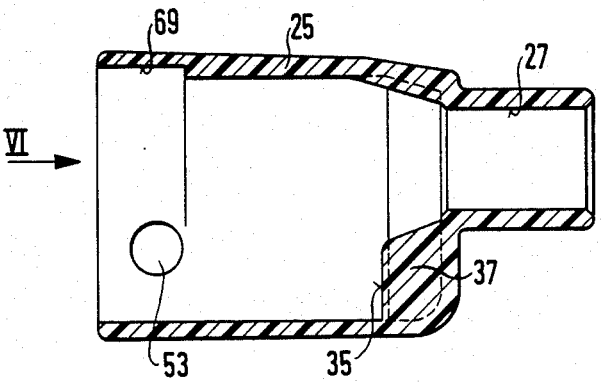
FIG. 4 a longitudinal section through the housing cap of FIG. 2, viewed along a line IV—IV of FIG. 6.
Figure 6:
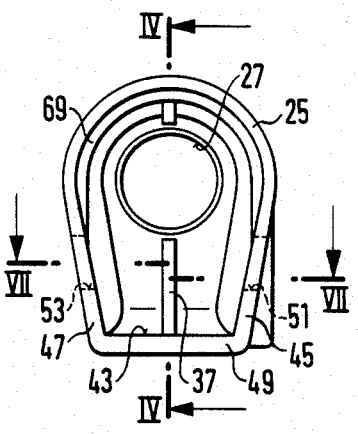
FIG. 6 an end view of the housing cap, viewed in the direction of arrow VI in FIG. 4.
Figure 7:
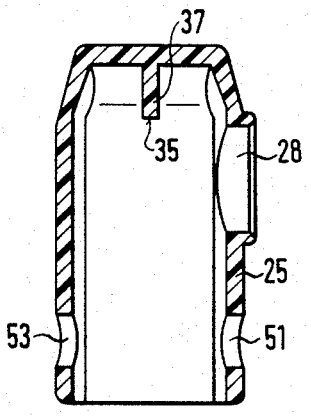
FIG. 7 a longitudinal section through the housing cap, viewed along a line VII—VII in FIG. 6.
Figure 8:
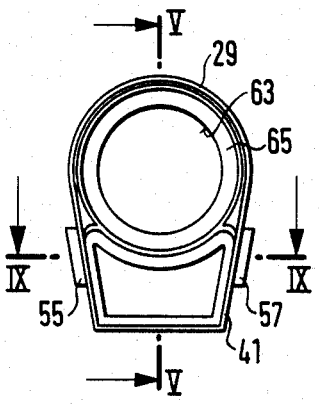
FIG. 8 an end view of the clamping piece, viewed in the direction of arrow VIII in FIG. 5.
Figure 9:
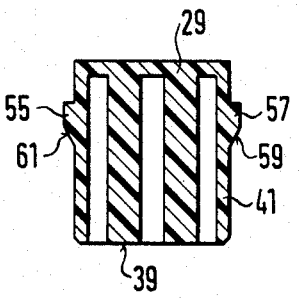
FIG. 9 a sectional view of the clamping piece, viewed on a line IX—IX in FIG. 8.

The cable lock illustrated in FIG. 1 has an elongate lock body 1, of substantially circular cross-section and slightly barrel-shaped longitudinal section, to which a flexible cable portion 3 is secured by its one end 5 by a pinched nozzle 7 of the lock body 1, the cable portion being oriented longitudinally of this body 1. The cable portion 3, covered with a protective plastics tube 9, carries at its other end a bolt piece 11, which can be pushed transversely to the longitudinal direction of the lock body 1 into a socket channel 13 of a socket block 15 of the lock body 1. A cylindrical core 17 of a cylinder lock is mounted in the lock body 1 rotatable about its longitudinal axis, the key channel 19 of this cylinder core for receiving a key 21 being open at the side of the lock body 1 opposite to the end 5 of the cable portion 3. When the bolt piece 11 is inserted into the socket channel 13, it automatically locks on the lock body 1 and can be unlocked by means of the key 21.

The lock body 1 is covered substantially completely by a two-part plastics housing 23, the details of which are shown in FIGS. 2 to 9. The plastics housing 23 comprises a substantially tubular housing cap 25 having a through opening 27 for the end 5 of the cable portion 3 and a through opening 28 for the bolt piece 11. Opposite to the end of the cable portion 3, an annular clamping piece 29 is pushed into the housing cap 25 and locks with the housing cap 25 in the manner to be described below. The plastics housing 23 is fixed form-fittingly on all sides against the socket block 15, which projects from the lock body 1 transversely to the socket channel 13 and transversely to the longitudinal axis of the lock body 1. The socket block 15 has two abutment surfaces 31, 33, facing away from each other in the longitudinal direction of the lock body 1. Against the abutment surface 31, facing towards the end 5 of the cable portion 3, there bears an abutment surface 35, oriented opposite to it, of a rib 37 projecting laterally of the through opening 27 in the housing cap 25. Against the abutment surface 33, there bears an end face 39 of a projection 41 of the clamping piece 29. This projection 41 engages into an outwardly open pocket 43, formed between the lock body 1 and the housing cap 25 in a continuation of the socket block 15. Whereas the housing cap 25 follows the cylindrical form of the lock body 1 on the side diametrically opposite the socket block 15, lateral walls 45, 47, which extend from the key entry side of the lock body 1 longitudinally to beyond the socket block 15, adjoin one another on either side of the socket block 15 on the side nearest the socket block 15. The lateral walls 45, 47 surround the socket block 15 and continue into one another in a transverse wall 49 forming the pocket 43. The plastics housing 23 thus has a solid appearance, determined by the transverse dimensions of the socket block 15, and the ease of handling of the cable lock is thereby improved.

The two lateral walls 45, 47 of the housing cap 25 are furnished, in the region of the pocket 43, with detent holes 51, 53, with which detent knobs 55, 57, projecting outwardly from the clamping piece 29, are associated. The detent knobs 55, 57 have inclined surfaces 59, 61 and snap into the detent holes 51, 53 when the clamping piece 29 is pushed in. The peripheral length of the housing cap 25, increased in the region of the pocket 43, permits a sufficient outward deflection of the lateral walls 45, 47, even where the dimensional tolerances are comparatively low, and thus permits passage of the detent knobs 55, 57. The detent knobs 55, 57 lie flush with the outer faces of the cap 25 in the region of the lateral walls 45, 47.

The clamping piece 29 enters substantially completely into the housing cap 25 and is substantially flush with it on the outside. The clamping piece 29 has a through opening 63 for the key 21, into which opening an annular flange 65 projects radially inwards. The annular flange 65 radially overlaps, at least slightly, the cylindrical core 17 and covers in a protective manner the annular gap remaining between the cylindrical core 17 and lock body 1.

The internal surfaces of the clamping piece 29 and housing cap 25 diverge conically at least partly towards each other, to enable the lock body 1 to be fixed in a manner preventing tilting, in spite of its barrel-shaped form in the longitudinal direction. The clamping piece 29 is housed form-fittingly in the housing cap 25, its region 67, diametrically opposite the projection 41, being seated in a recess 69 of the housing cap 25.

Figure 10:
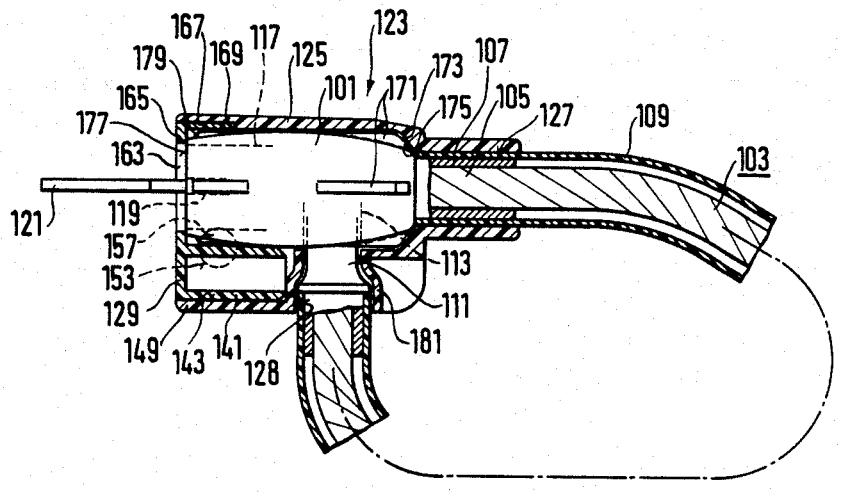
FIG. 10 a partial longitudinal section through a variant of the cable lock according to FIGS. 1 to 9.

FIG. 10 shows a variant of the cable lock explained by reference to FIGS. 1 to 9, this variant differing essentially from this lock in that its lock body does not have any socket block. Parts having the same function bear the same reference numerals as in FIGS. 1 to 9, but increased by the number 100 to indicate the distinction. For a further explanation of the construction and method of functioning, reference should be made to the description of FIGS. 1 to 9. The components 45, 47, 51, 55, 59 and 61 are not illustrated in FIG. 10, but are present.

The lock body 101 of the cable lock of FIG. 10 has a socket channel 113, oriented transversely to the longitudinal direction, into which channel the bolt piece 111 is directly pushed. The lock body has an elongate external form, basically circular in cross-section and rounded to barrel shape longitudinally, and carries a plurality of ribs 171, oriented in the longitudinal direction and distributed around its circumference, the end surfaces 173 of which ribs, pointing towards the end 105 of the cable portion 103, constitute abutment surfaces, against which a counter-surface 175, surrounding the through opening 127, bears. The surfaces 173, 175 correspond to the surfaces 31, 35 in FIG. 1. Fixing in the opposite direction is provided by the inwardly projecting annular flange 165 of the clamping piece 129 at the end face 177 of the lock body 101 remote from the end 105 of the cable portion 103. Reference 179 denotes ribs, similar to the ribs 171, the end surfaces of which can also bear against the annular flange 165.

The cap 125 once again forms a pocket 143, which is however bounded, in the longitudinal direction of the lock body 101, by an annular projection 181. The annular projection 181 is aligned with the socket channel 113 and forms a continuation of this by the height of the pocket 143. The height of the pocket 143 is determined by lateral walls, not shown in more detail, similar to the walls 47, 45 (FIG. 6), detent openings, such as the detent opening 153, being provided in the lateral walls for detent knobs provided on the clamping piece 129. In FIG. 10, only the detent knob 157 is indicated.

While specific embodiments of the invention have been shown and described in detail to illustrate the application of the inventive principles, it will be understood that the invention may be embodied otherwise without departing from such principles.

What I claim is:

1. A cable lock, comprising (a) a flexible cable portion, (b) an elongate lock body (1;101) to which the cable portion (3;103) is secured, oriented in the longitudinal direction of the lock body (1; 101), by a first end (5; 105), and can be attached, oriented transversely to the longitudinal direction of the lock body (1;101), by a second end (11; 111), wherein said lock body (1; 101) contains a key channel (19; 119) for a cylinder lock, accessible from the end opposite in the longitudinal direction to the first end (5;

105) of the cable portion (3; 103) and possesses first abutment surfaces (31; 33; 173; 177) facing away from each other in its longitudinal direction, (c) a housing (22; 123) of plastics material encompassing the lock body (1; 101) and having through openings (27, 28; 127, 128) for the ends (5, 11; 105, 111) of the cable portion (3; 103), wherein said housing (23; 123) comprises two housing parts (25, 29; 125, 129) pushed into one another in the longitudinal direction of the lock body (1; 101) and secured to one another when pushed in, said housing parts having second abutment surfaces (35, 39; 165, 175), facing towards each other in the longitudinal direction of the lock body (1; 101), and enclosing said first abutment surfaces (31, 33; 193, 177) of the lock body between them, wherein a first of the first of two housing parts (25, 29; 125, 129) is a tubular cap (25; 105), which can be pushed onto the lock body (1; 101) in the longitudinal direction, which cap (25; 125) forms a pocket (43; 143) open in the push-in direction and wherein the second housing part is formed as an annular component (29, 129) which can be pushed over its axial length substantially completely into the pocket (43, 143) of the cap (25; 105).

2. A cable lock according to claim 1, wherein a socket block (15) projects transversely to the longitudinal direction, which contains a socket channel (13) for the second end (11) of the cable portion and forms said first two abutment surfaces (31, 33), of the lock body (1), wherein the cap (25) surrounds the lock body (1), including the socket block (15) and the pocket (43) extends as far as the socket block (15), and wherein said annular component (29) encloses the lock body (1) and has a projection (41) projecting in the longitudinal direction of the lock body (1) into the pocket (43).

3. A cable lock according to claim 1, wherein the lock body (101) contains socket channel (113) oriented transversely to the longitudinal direction for the pushing-in of the second end (111) of the cable portion (103), wherein the cap (105) possesses a tubular projection (181) axially aligned with the socket channel (113), which tubular projection (181) bounds the pocket (143) in the longitudinal direction of the lock body (101) and wherein said annular component (129) encloses the lock body (101 and has a projection (141) projecting in the longitudinal direction of the lock body (101) into the pocket (143).

4. A cable lock according to claim 3, wherein said first abutment surfaces (173, 177) are formed in the longitudinal direction on at least one side of the lock body (101) by end surfaces (173) facing in the longitudinal direction, of several ribs (171), integrally formed on the lock body (101) and extending in the longitudinal direction.

5. A cable lock according to claim 1, wherein the lock body (1; 101) rotatably contains a lock cylinder (17; 117) wherein the cap (25; 125) is closed at its one end except for the through opening (17; 127) of the first end (d; 105) of the cable portion (13; 103), and wherein the second housing part (29; 129) possesses an annular flange (65; 165), extending at least as far as the end circumference of the lock cylinder (17; 117) and preferably overlapping the latter, which annular flange (65; 165) forms a boundary to a key introduction opening (63; 163), coaxial with the lock cylinder (17; 117) of the housing (23; 123).

6. A cable lock according to claim 1, wherein the two housing parts (25, 29; 125, 129) are fixed to one another int he longitudinal direction of the lock body (1; 101) by a detent connection, wherein one of the housing parts (25; 125) surrounds the lock body (1; 101) forming a pocket (43; !43) open in the longitudinal direction, the pocket (43, 143) possessing two lateral walls (45; 47) oriented substantially tangentially to the lock body (1; 101), which walls (45; 47) continue into each other at a distance from the lock body (1; 101), wherein the other housing part (29; 129) possesses a projection (41; 141) which can be pushed into the pocket (43; 143), and wherein detent connections, consisting each of a detent knob (55, 57; 157) and a complementary detent recess 51, 53; 153) are provided on the projection (41; 141) and on the two lateral walls (45, 47).

7. A cable lock according to claim 6, wherein the detent recesses (51, 53; 153) are provided in the lateral walls (45, 47) of the pocket (43; 143) and wherein the detent knobs (55, 57; 157) are equipped with feed-in oblique surfaces (59, 61).

8. A cable lock according to claim 6, wherein the detent knobs (55, 57; 157) are substantially flush with the outer surfaces of the lateral walls (45, 47) when the housing parts (25, 29; 125, 129) are pushed into each other.

* * * * *